US006994517B2

(12) United States Patent
Gatley, Jr. et al.

(10) Patent No.: US 6,994,517 B2
(45) Date of Patent: Feb. 7, 2006

(54) FURNACE BLOWER APPARATUS WITH REMOVABLE HOUSING SECTION FAN ASSEMBLY SUPPORT

(75) Inventors: William Stuart Gatley, Jr., Cassville, MO (US); Rex Allen Rothgangel, Belleville, IL (US); Joan Teresa Richter, Breese, IL (US); Michael Lynn Kennedy, Wheaton, MO (US)

(73) Assignee: Jakel Incorporated, Highland, IL (US)

( * ) Notice: Subject to any disclaimer, the term of this patent is extended or adjusted under 35 U.S.C. 154(b) by 88 days.

(21) Appl. No.: 10/767,367

(22) Filed: Jan. 28, 2004

(65) Prior Publication Data

US 2005/0163613 A1 Jul. 28, 2005

(51) Int. Cl.
*F04E 29/52* (2006.01)

(52) U.S. Cl. ..... 415/126; 415/201; 415/214.1

(58) Field of Classification Search ..... 415/126, 415/214.1, 220, 223, 201; 416/244 R; 417/360, 417/423.14

See application file for complete search history.

(56) References Cited

U.S. PATENT DOCUMENTS

| | | | | |
|---|---|---|---|---|
| 2,932,441 | A * | 4/1960 | Harp | 417/360 |
| 3,871,795 | A * | 3/1975 | Habdo et al. | 417/360 |
| 4,775,294 | A * | 10/1988 | LaPorte | 415/201 |
| 4,924,848 | A | 5/1990 | Vaughn | |
| 5,992,410 | A | 11/1999 | Raleigh et al. | |

* cited by examiner

*Primary Examiner*—Ninh H. Nguyen
(74) *Attorney, Agent, or Firm*—Thompson Coburn LLP

(57) ABSTRACT

A furnace blower apparatus has a tubular housing that is connected between a heating furnace and an exhaust flue of the furnace. The housing has an interior bore containing a fan assembly for drawing air through the furnace burner chamber on operation of the fan assembly. The housing includes a panel that is removably mounted to a side wall of the housing. The fan assembly is mounted to an interior surface of the panel, whereby the fan assembly can be removed from the interior of the housing by removing the panel from the housing.

20 Claims, 4 Drawing Sheets

FURNACE BLOWER APPARATUS WITH REMOVABLE HOUSING SECTION FAN ASSEMBLY SUPPORT

BACKGROUND OF THE INVENTION (1) Field of the Invention

The present invention pertains to a furnace blower apparatus having a blower housing with a removable panel to which a fan assembly is mounted. More specifically, the present invention pertains to a furnace blower apparatus having a tubular housing that is connected between a furnace and an exhaust flue of the furnace. The housing has an interior bore containing a fan assembly for drawing air through the furnace burner chamber on operation of the fan assembly. The housing includes a panel that is removably mounted to a side wall of the housing. The fan assembly is mounted to an interior surface of the panel, whereby the fan assembly can be removed from the interior of the housing by removing the panel from the housing.

(2) Description of the Related Art

A typical heating furnace that is used in heating the interior of a home or other similar dwelling structure basically comprises an enclosure containing a combustion burner, a combustion burner blower, a heat exchanger, and a heat exchanger blower. The combustion burner blower is operative to draw ambient air into the combustion burner where it is mixed with a fuel, for example gas, as the fuel is burned. The combustion burner blower also draws the exhaust byproducts of combustion from the combustion burner and directs the exhaust to an exhaust flue connected with the furnace.

The combustion of the combustion burner heats the heat exchanger. The heat exchanger blower draws ambient air through the heat exchanger where the ambient air is heated by the combustion burner. The heat exchanger blower then directs the heated air into the interior environment of the dwelling, heating the interior environment.

The typical construction of a residential furnace described above usually requires a substantial area in the residential dwelling. The area required by the furnace not only must be large enough to accommodate the furnace, but also must be slightly larger in order to enable a free flow of ambient air into the furnace enclosure to provide air for combustion and air to be heated by the furnace. The larger the dwelling being heated by the furnace, the larger furnace construction must be.

Smaller dwellings, for example manufactured homes or mobile homes, typically do not require a larger furnace construction to provide heat to the interior of the dwelling. Furnaces for smaller dwellings have been designed with a much more compact construction. For example, the combustion burner blower has been designed where a fan assembly that draws air through the combustion burner is contained inside a tubular housing that also functions as part of the exhaust flue. This results in a reduction in the overall size of the furnace, because additional space in the furnace enclosure is not required for a combustion burner blower that is a separate component part from the combustion burner and from the exhaust flue of the furnace.

However, compact furnace constructions such as that described above have drawbacks that are attributed to their compact size. For example, in the compact furnace assembly comprising the fan assembly mounted in the tubular housing that communicates the furnace burner with the exhaust flue, it is necessary to disassemble the tubular housing from its position between the furnace enclosure and the exhaust flue to service or replace the fan assembly. Thus, repair of this type of furnace assembly is time-consuming and difficult.

What is needed to overcome the disadvantages associated with compact furnace constructions is a furnace blower apparatus specifically designed for compact furnace constructions where the fan assembly of the apparatus is easily accessed for servicing of the fan assembly.

SUMMARY OF THE INVENTION

The furnace blower apparatus of the present invention overcomes the disadvantages associated with prior art compact furnace constructions by providing a blower apparatus in which the fan assembly is easily removed from the apparatus for servicing or replacement.

The furnace blower apparatus of the present invention is basically comprised of a tubular housing containing a fan assembly. The tubular housing is dimensioned to fit between a conventional furnace used in smaller dwellings, for example in mobile homes, and an exhaust flue or vent pipe of the furnace that vents exhaust gas from furnace combustion to the exterior environment of the dwelling.

The tubular housing has a cylindrical length with opposite input and output ends. The housing has a hollow interior volume along its length. A cylindrical side wall of the housing has a side wall opening that communicates the interior bore of the housing with the exterior environment of the apparatus.

A circular end wall is provided at the output end of the housing covering over an output opening of the housing. The end wall has a circular air flow aperture at its center. Changing the diameter dimension of the air flow aperture changes the flow rate of air through the housing.

A panel is removably attached to the blower housing side wall. The panel completely covers over the side wall opening. Separate fasteners are employed in removably attaching the panel to the side wall. By removing the separate fasteners the panel can be completely removed from the side wall, exposing the side wall opening.

The fan assembly is mounted to an interior surface of the panel. With the panel mounted to the blower housing over the side wall opening, a fan of the fan assembly is centered in the interior bore of the housing. Operation of the fan draws air through the combustion chamber of the furnace and pushes exhaust gases of combustion through the exhaust vent flue of the dwelling.

When servicing of the fan assembly is required, the panel is removed from the side wall of the blower housing. With the fan assembly attached to the interior surface of the panel, the fan assembly is removed from the housing side wall with the panel. This enables the fan to be replaced or serviced outside of the blower housing without removing the portion of the tubular housing between the furnace and the exhaust flue. With the fan assembly replaced or repaired and attached to the interior surface of the panel, replacing the panel on the blower housing positions the fan assembly in the blower housing interior bore and completes the repair or replacement of the fan assembly without requiring removal of the blower housing from between the furnace and the exhaust flue.

BRIEF DESCRIPTION OF THE DRAWING FIGURES

Further features of the invention are set forth in the following detailed description of a preferred embodiment of the invention and in the drawing figures wherein.

DETAILED DESCRIPTION OF THE PREFERRED EMBODIMENT

Figure 1:
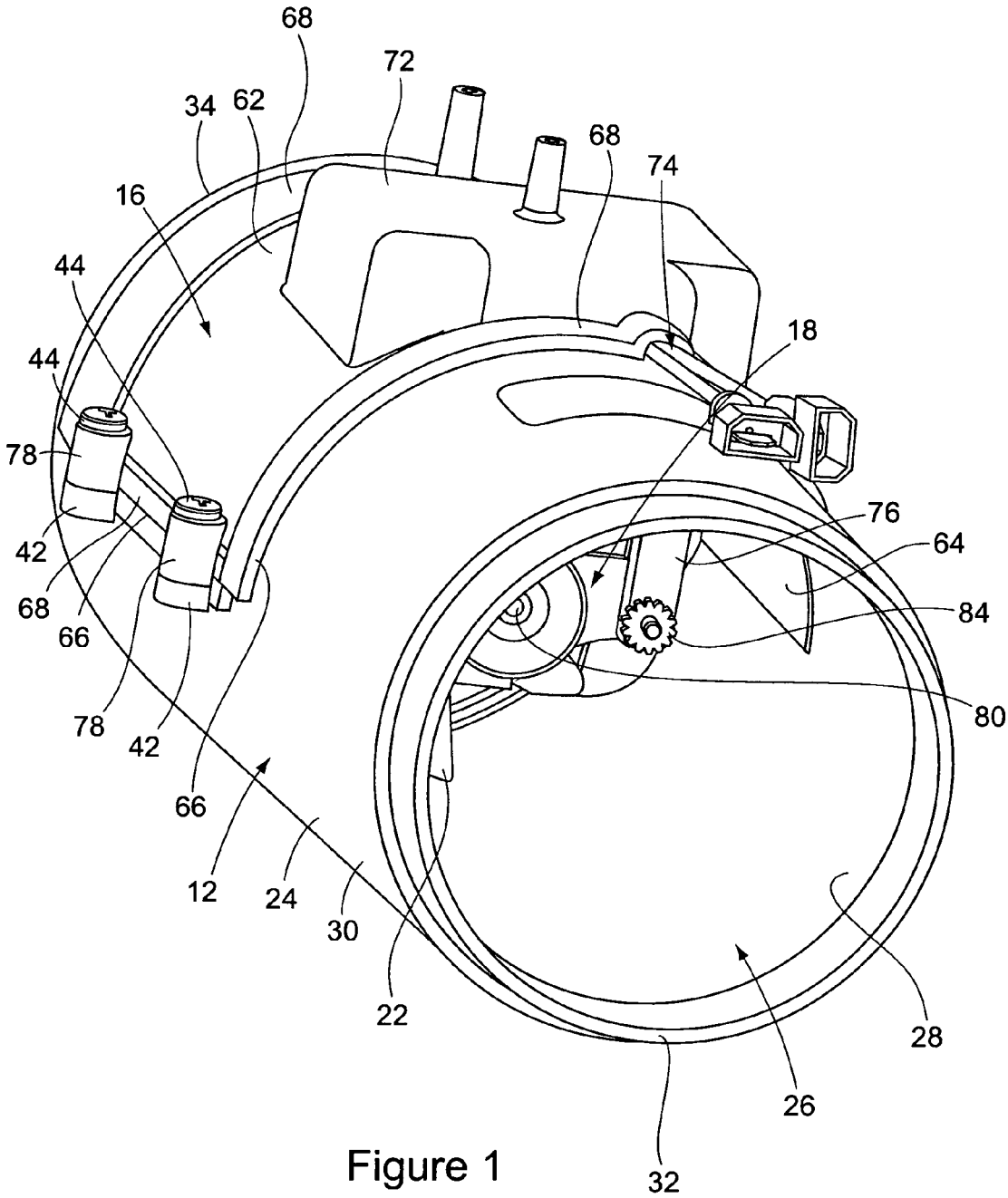
FIG. 1 is a front perspective view of the furnace blower apparatus of the invention.
Figure 2:
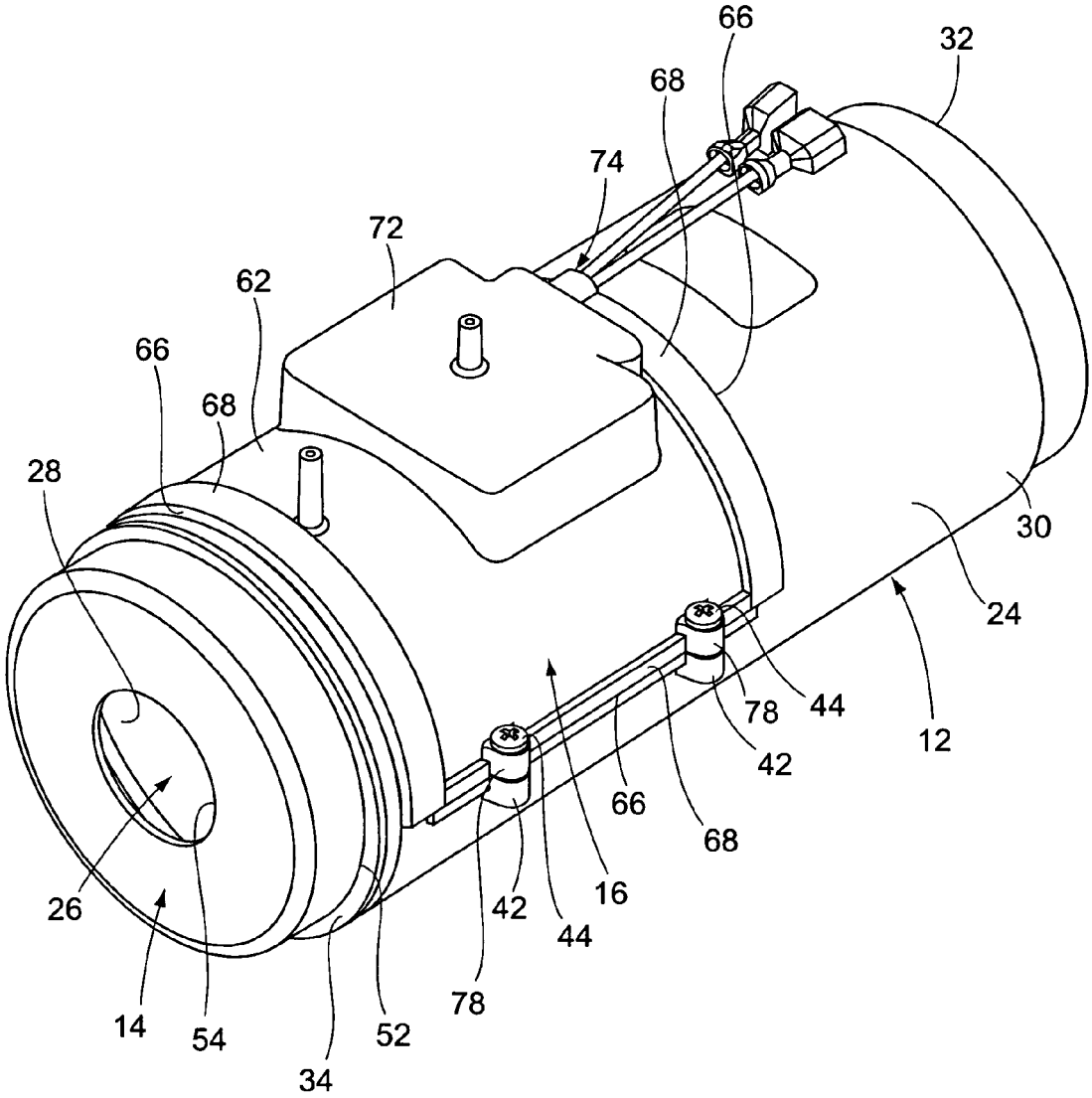
FIG. 2 is a rear perspective view of the apparatus of FIG. 1.

The furnace blower apparatus of the present invention is show in FIGS. 1–4, and is basically comprised of a blower housing assembly containing a fan assembly. The furnace blower apparatus is designed for use in smaller dwellings, such as manufactured homes and mobile homes. However, the furnace blower apparatus may be employed in other environments. The materials employed in manufacturing the blower housing assembly and the fan assembly are not novel aspects of the invention, and therefore materials typically employed in manufacturing conventional furnace blower housings and fan assemblies may be employed in manufacturing the furnace blower apparatus of the invention. The blower housing assembly is basically comprised of a tubular housing 12, a circular end wall 14, and a removable panel 16. The fan assembly is basically comprised of a fan motor 18 and a fan 22.

The tubular housing 12 is comprised of a cylindrical side wall 24 having a length with opposite input and output ends. A hollow interior bore 26 extends through the entire length of the side wall 24. The housing side wall 24 has a cylindrical interior surface 28 that surrounds the interior bore 26. The housing side wall 24 also has a cylindrical exterior surface 30. An annular input end edge 32 of the side wall surrounds an input opening into the side wall interior bore 26. An annular output end edge 34 of the side wall surrounds an output opening into with the side wall interior bore 26. The housing input end edge 32 is adapted to be operatively connected to a furnace to communicate the housing interior bore 26 with combustion gases exhausted from the furnace. The housing output end edge 34 is adapted to be operatively connected with a vent pipe or exhaust flue of a dwelling that exhausts combustion gases from the dwelling.

Figure 3:
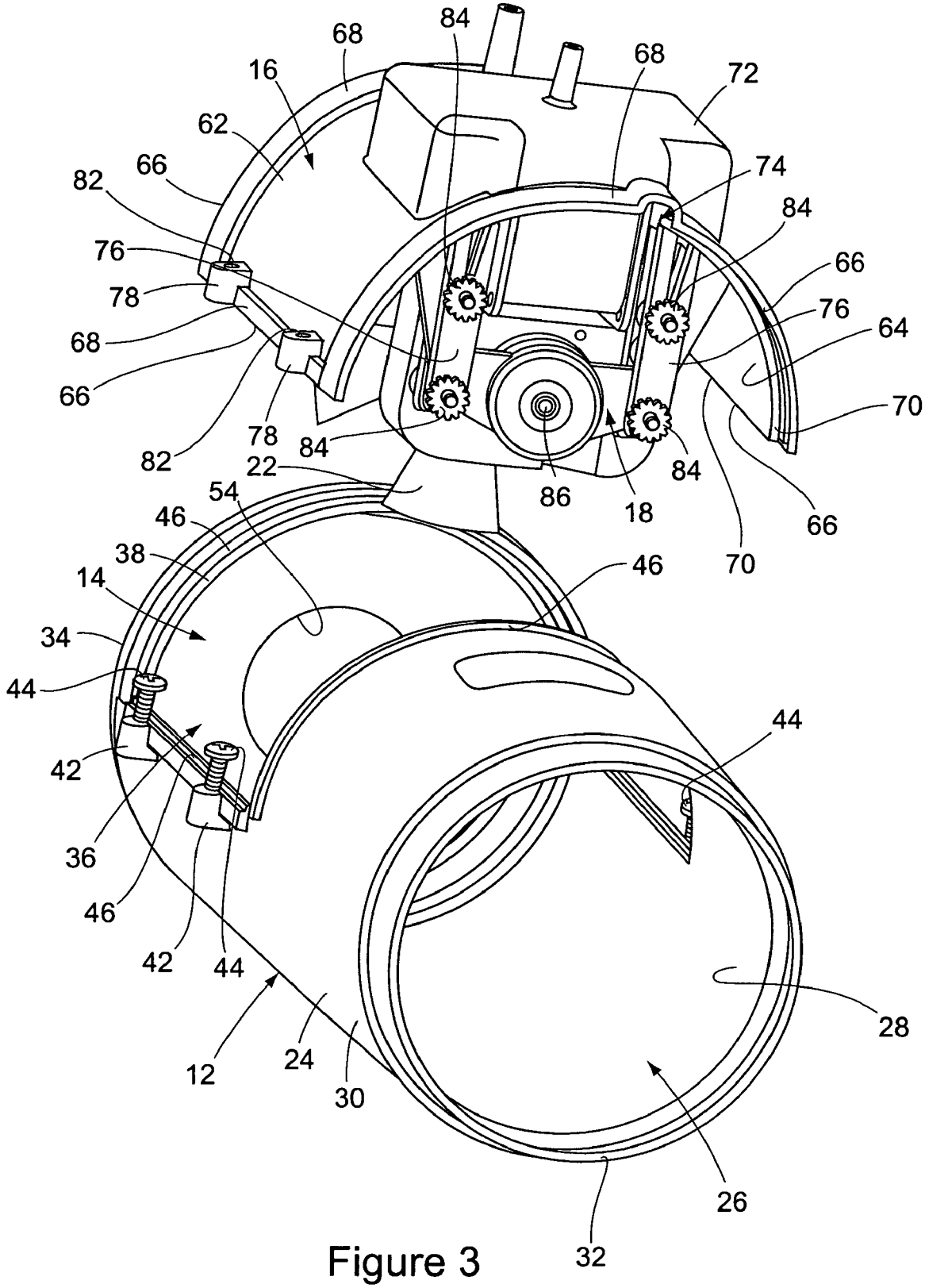
FIG. 3 is a front perspective view of the apparatus similar to that of FIG. 1, with the panel and fan assembly of the apparatus removed; and, FIG. 4 is a rear perspective view of the apparatus as shown in FIG. 3.
Figure 4:
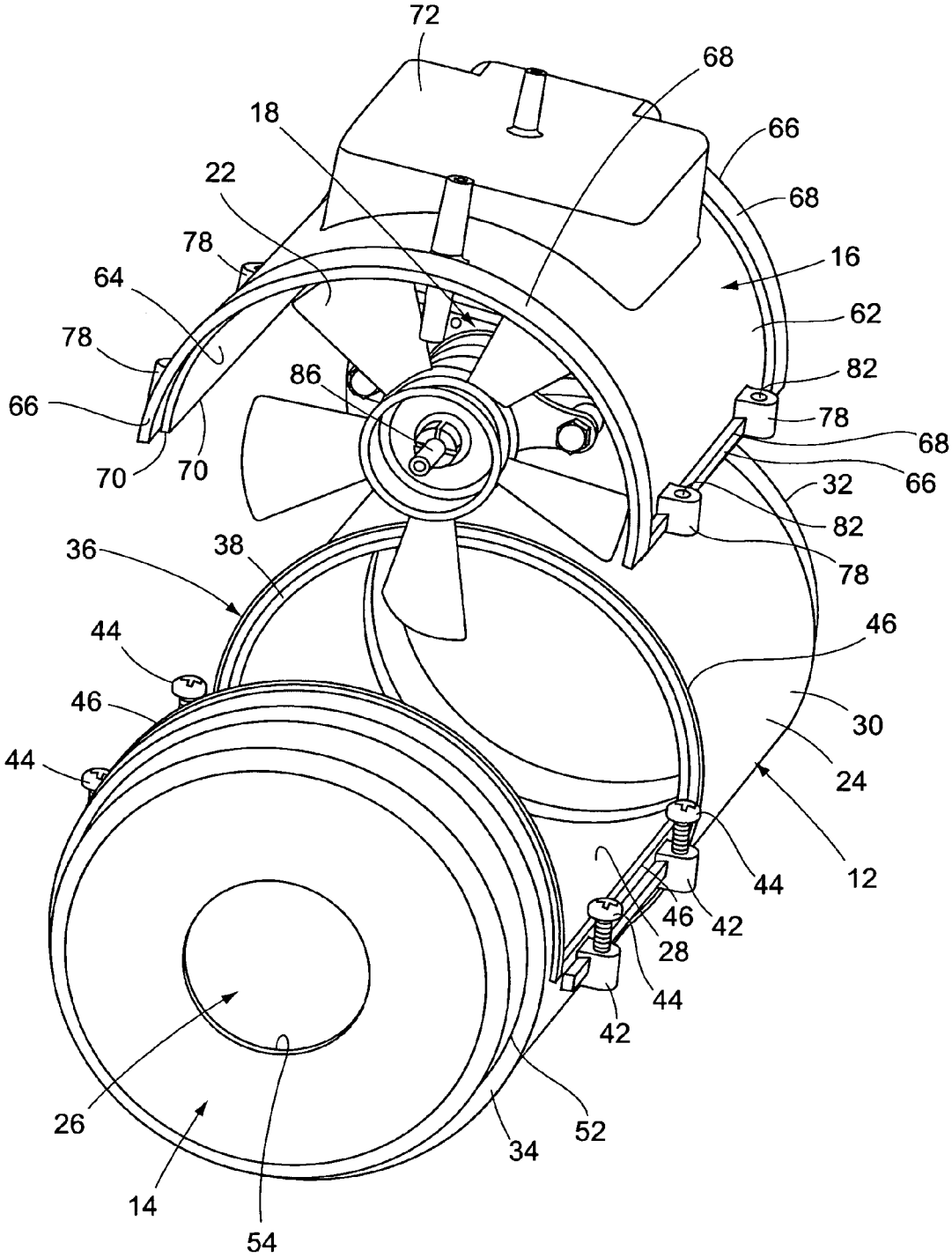

A side wall opening 36 is provided through the housing side wall 24. The side wall opening 36 is defined by an edge 38 of the side wall that has a generally rectangular configuration. As best seen in FIGS. 3 and 4, the side wall opening edge 38 extends along a portion of the length of the housing side wall 24 and is spaced from the side wall input end edge 32 and from the side wall output end edge 34. The side wall opening edge 38 also extends around about one-half of the circumference of the housing side wall 24.

As shown in FIGS. 3 and 4, two pairs of side wall protrusions 42 project outwardly from the side wall exterior surface 30. Each pair of protrusions 42 is positioned adjacent the side wall opening edge 38 on diametrically opposite sides of the side wall interior bore 26. The pairs of protrusions 42 on the opposite sides of the side wall opening 36 are also spaced from each other along the length of the housing 12. Each of the side wall protrusions 42 is provided with an internally threaded hole (not shown) that removably receives a threaded fastener 44.

The circular end wall 14 is removably attached to the output end edge 34 of the tubular housing 12. In removably attaching the end wall 14 to the tubular housing 12, the peripheral portion 52 of the end wall 14 may be provided with screw threading that is complementary to screw threading provided on the housing side wall output end edge 34. Other means of attaching the end wall 14 to the tubular housing output edge 34 may also be employed.

A circular air flow aperture, defined by an inner edge 54 of the end wall 14, passes through the end wall. The air flow aperture inner edge 54 is centered in the end wall 14. The diameter of the end wall aperture inner edge 54 determines the rate of air flow through the tubular housing 12. By changing end walls 14 on the tubular housing 12, with each end wall having a different diameter aperture defined by the end wall inner edge 54, the rate of air flow through the tubular housing 12 may be adjusted.

A narrow ridge 46 extends around the side wall opening 36. The ridge 46 is positioned adjacent the side wall opening edge 38 and projects outwardly from the side wall exterior surface 30. The side wall protrusions 42 are positioned on the side wall exterior surface 30 outside of the ridge 46.

The panel 16 is designed to be removably attached to the housing side wall 24 over the side wall opening 36. The panel 16 has a curved configuration with opposite exterior 62 and interior 64 surfaces. The panel exterior surface 62 is a convex surface and the panel interior surface 64 is a concave surface. The size of the panel 16 is defined by the rectangular panel outer edge 66. The panel edge 66 has the same general shape as the side wall opening edge 38, but is slightly larger than the side wall opening edge. This enables the panel 16 to overlap the sidewall opening 36. The panel edge 66 is defined by a raised border 68 that extends completely around the panel and projects radially outwardly from the panel edge. The raised border 68 forms an inwardly projecting ridge 70 on the panel interior surface 64. The ridge 70 is dimensioned to be received inside the side wall rim 46 when removably attaching the panel 16 to the tubular housing 12 to properly position the panel 16 relative to the side wall opening 36.

A motor mount wall 72 projects outwardly from the side wall exterior surface 30. The motor mount wall 72 has a shape that is complementary to a shape of the exterior surface of the fan motor 18. The motor mount wall 72 defines a recessed cavity (not shown) in the side wall interior surface 28 that is dimensioned to receive a portion of the fan motor 18. The cavity in the motor mount wall 72 properly positions the fan motor 18 relative to the interior bore 26 of the tubular housing 12 when the panel 16 is attached to the housing 12. A wiring opening 74 extends through the panel edge 66 and communicates with the cavity of the motor mount wall 72. The wiring opening 74 provides a passage for the wiring of the fan motor 18.

A plurality of arms 76 project inwardly from the panel interior surface 64. The arms 76 are positioned on the panel interior surface 64 where they will extend over opposite ends of the fan motor 18 when the fan motor is positioned in the cavity defined by the motor mount wall 72. Each of the arms 76 has an opening (not shown) for accommodating a removable fastener of the fan motor 18.

A plurality of panel protrusions 78 project outwardly from the panel exterior surface 62. The panel protrusions 78 are arranged in pairs on opposite sides of the panel 16 adjacent the panel peripheral edge 66. A hole 82 extends through each of the panel protrusions 78. The panel protrusions 78 are positioned on the panel 16 where the panel protrusion holes 82 will align with the internally threaded holes of the side wall protrusions 42 when the panel 16 is positioned over the side wall opening 36.

The fan motor 18 is a conventional motor used in furnace applications for smaller dwellings. A portion of the motor 18 is received in the cavity defined by the motor mount wall 72. This positions removable fasteners 84 of the motor in the openings of the panel arms 76. Threaded bolts and nuts are shown as the motor removable fasteners 84 in the drawing figures. Other equivalent types of fasteners may be used.

The fan 22 is mounted on a shaft 86 of the fan motor 18. The positioning of the fan motor 18 on the panel 16 by the panel arms 76 positions the fan 22 in the center of the tubular housing interior bore 26 when the panel 16 is attached to the housing 12.

In attaching the removable panel 16 and the fan assembly to the tubular housing 12, the fan motor 18 and fan 22 attached to the panel interior surface 64 are inserted through the housing side wall opening 36. The panel protrusions 78 are positioned against the side wall protrusions 42 and the panel inwardly projecting ridge 70 is positioned inside the side wall rim 46. The separate removable fasteners 44 of the tubular housing are then inserted through the holes 82 of the panel protrusions 78 and are screw threaded into the internally threaded holes (not shown) of the housing side wall protrusions 42. This removably attaches the panel 16 to the tubular housing 12.

To service the fan motor 18, it is only necessary to remove the housing threaded fasteners 44. This enables the removable panel 16 to be removed from the tubular housing 12, with the fan motor 18 attached to the panel interior surface 64 being withdrawn from the tubular housing interior bore 26 through the housing side wall opening 36. With the fan motor 18 and fan 22 being removed to the exterior environment of the furnace blower apparatus by removing the removable panel 16 from the tubular housing 12, the fan motor 18 and fan 22 can be easily serviced or replaced. When the servicing or replacement is completed, the fan motor 18 and fan 22 are inserted through the side wall opening 36 and the removable panel 16 is reattached to the tubular housing 12 by the threaded fasteners 44.

Although the furnace blower apparatus of the invention has been described above by reference to one embodiment of the invention, it should be understood that modifications and variations could be made to the described apparatus without departing from the intended scope of the following claims.

What is claimed is:

1. A furnace blower apparatus comprising:

a tubular housing having a length with opposite input and output ends and a hollow interior bore extending through the housing length between the input and output ends;

a panel attached to the housing; and a fan assembly attached to the panel and positioned in the housing interior bore, the fan assembly including a motor and a fan attached to the motor, and the fan assembly being removable from the housing interior bore by removing the panel from the housing.

2. The apparatus of claim 1, further comprising:

the panel being removably attached to the housing.

3. The apparatus of claim 2, further comprising:

the panel being removably attached to the housing by separate fasteners that are removable from the housing.

4. A furnace blower apparatus comprising:

a tubular housing having a length with opposite input and output ends and a hollow interior bore extending through the housing length between the input and output ends;

a panel attached to the housing;

a fan assembly attached to the panel and positioned in the housing interior bore, and the fan assembly being removable from the housing interior bore by removing the panel from the housing; and the fan assembly including a motor that is attached to the panel in the housing interior bore and a fan that is mounted on the motor for rotation of the fan in the housing interior bore by the motor.

5. The apparatus of claim 4, further comprising:

the panel attached to the housing having an opening; and, the fan assembly having at least one wire that extends from the fan assembly in the housing interior bore, through the opening to an exterior environment of the apparatus.

6. The apparatus of claim 4, further comprising:

the housing having a side wall that extends around the housing interior bore;

the side wall having an opening through the side wall to the housing interior bore; and, the panel attached to the housing covering over the side wall opening.

7. The apparatus of claim 6, further comprising:

the side wall having an input edge surrounding an input opening at the input end of the housing;

the side wall having an output edge surrounding an output opening at the output end of the housing; and, the side wall opening being spaced between the input edge and the output edge.

8. The apparatus of claim 4, further comprising:

the housing input end being adapted for communication with a heating furnace and the housing output end being adapted for communication with a furnace exhaust.

9. The apparatus of claim 4, further comprising:

the housing having a cylindrical side wall that extends around the housing interior bore; and, the panel having a curved configuration that overlaps the housing cylindrical side wall.

10. The apparatus of claim 9, further comprising:

the panel having opposite convex and concave surfaces, and the fan assembly being attached to the panel concave surface.

11. The apparatus of claim 4, further comprising:

the housing having an interior surface that opposes the housing interior bore;

the panel having an interior surface that opposes the housing interior bore; and, the fan assembly being attached solely to the panel interior surface.

12. A furnace blower apparatus comprising:

a tubular housing having a length with opposite input and output ends and a hollow interior bore extending through the housing length between the input and output ends;

a panel attached to the housing;

a fan assembly attached to the panel and positioned in the housing interior bore, and the fan assembly being removable from the housing interior bore by removing the panel from the housing; and an end wall attached to one of the housing input end and output end, the end wall having an air flow aperture through the end wall.

13. The apparatus of claim 12, further comprising:

the end wall being one of a plurality of end walls that are each attachable to one of the housing input end and output end, and each of the end walls having an air flow aperture that is a different size from the air flow apertures of the other end walls of the plurality of end walls.

14. A method of facilitating repair of a furnace blower, the method comprising:

providing a tubular housing with a length with opposite input and output ends and a hollow interior bore extending through the housing;

attaching a panel to the housing; and, attaching a fan assembly that includes a motor and a fan to the panel where the motor and fan of the fan assembly are positioned in the housing interior bore when the panel is attached to the housing.

15. A method of facilitating repair of a furnace blower, the method comprising:

providing a tubular housing with a length with opposite input and output ends and a hollow interior bore extending through the housing;

attaching a panel to the housing;

attaching a fan assembly to the panel where the fan assembly is positioned in the housing interior bore when the panel is attached to the housing;

providing the panel attached to the housing with an opening; and, directing at least one wire of the fan assembly from the housing interior, through the panel opening, and to an exterior environment of the apparatus.

16. A method of facilitating repair of a furnace blower, the method comprising:

providing a tubular housing with a length with opposite input and output ends and a hollow interior bore extending through the housing;

attaching a panel to the housing;

attaching a fan assembly to the panel where the fan assembly is positioned in the housing interior bore when the panel is attached to the housing; and adapting the housing input end for communication with a heating furnace and adapting the housing output end for communication with a furnace exhaust.

17. The method of claim 16, further comprising:

providing an opening in the housing and inserting the fan assembly through the opening and into the housing interior bore when attaching the panel to the housing.

18. The method of claim 16, further comprising:

removably attaching the panel to the housing by separate, removable fasteners.

19. The method of claim 16, further comprising:

providing the housing with an input edge that extends around an input opening at the input end of the housing;

providing the housing with an output edge that extends around an output opening at the output end of the housing; and, positioning the opening in the side wall where the side wall opening is spaced from both the input edge and the output edge.

20. A method of facilitating repair of a furnace blower, the method comprising:

providing a tubular housing with a length with opposite input and output ends and a hollow interior bore extending through the housing;

attaching a panel to the housing;

attaching a fan assembly to the panel where the fan assembly is positioned in the housing interior bore when the panel is attached to the housing; and providing a plurality of end walls that are each attachable to one of the housing input end and output end, and providing each end wall with an air flow aperture that is a different size from the air flow apertures of the other end walls of the plurality of end walls.

* * * * *